US006565658B2

(12) United States Patent
Fischer et al.

(10) Patent No.: US 6,565,658 B2
(45) Date of Patent: May 20, 2003

(54) GLUE SPREADER

(75) Inventors: Peter Fischer, Winterthur (CH); Fritz Ammann, Frauenfeld (CH)

(73) Assignee: GraphaHolding AG, Hergiswil (CH)

( * ) Notice: Subject to any disclaimer, the term of this patent is extended or adjusted under 35 U.S.C. 154(b) by 0 days.

(21) Appl. No.: 09/987,989

(22) Filed: Nov. 16, 2001

(65) Prior Publication Data

US 2002/0061241 A1 May 23, 2002

(30) Foreign Application Priority Data

Nov. 17, 2000 (EP) ..... 00811089

(51) Int. Cl.[7] ..... B05C 1/02

(52) U.S. Cl. ..... 118/259; 118/261; 156/578; 156/908; 412/37

(58) Field of Search ..... 118/203, 244, 118/259, 261; 156/578, 908; 412/8, 37, 33

(56) References Cited

U.S. PATENT DOCUMENTS 4,014,287 A * 3/1977 Green ..... 118/696
4,335,674 A * 6/1982 Winker et al. ..... 118/110
4,588,470 A * 5/1986 Abegglen ..... 156/578
5,693,142 A 12/1997 Pedigrew et al.

FOREIGN PATENT DOCUMENTS

DE 197 22 456 A1 12/1998
EP 0 839 584 A2 5/1998

* cited by examiner

*Primary Examiner*—Laura Edwards
(74) *Attorney, Agent, or Firm*—Venable; Robert Kinberg

(57) ABSTRACT

A glue spreader for spreading glue to a back or adjacent area of a book block of gathered printed pages conveyed past the glue spreader on a conveyor includes a tub for holding the glue. At least one application roller, drivable in the same direction and at the same speed as the book block, is submerged in the tub in order to take up the glue and transfer the glue to the back of the book block. A blade coater is adapted for arrangement above the glue level in the tub at a changeable distance to the application roller. An actuation element is coupled to the blade coater for adjustment of the blade coater for determining a thickness of a glue film to be transferred to the book block back based on the changeable distance to the application roller. A controllable electric motor has a drive element and the actuation element of the blade coater is operatively connected to the drive element of the controllable electric motor.

7 Claims, 2 Drawing Sheets

GLUE SPREADER

CROSS-REFERENCE TO RELATED APPLICATIONS

Priority is claimed with respect to European Patent Application No. 00811089.2 filed in the European Patent Office on Nov. 17, 2000, the disclosure of which is incorporated herein by reference.

BACKGROUND OF THE INVENTION

The invention relates to a spreader for spreading glue to the back or the adjoining areas of a book block of gathered printed pages, conveyed past the spreader on a conveyor. The glue spreader comprises a tub containing glue, into which at least one application roller that takes up the glue and transfers it to the book block is submerged. A blade coater, provided with an actuation element for adjusting the coater, is assigned to the application roller above the glue level in the tub. The blade coater determines the glue film thickness to be transferred to the back of the book block on the basis of the changeable distance to the application roller. The manner in which the glue is spread on the back of a book block is critical for a high-quality adhesive binding. Applying the glue with the aid of application rollers that can be adjusted, relative to the book back, favorably influences the quality of the adhesive bonding. The glue is frequently transferred with two successively arranged rollers and, in the process, minimal amounts are pushed mechanically between the page edges, so that the pages are embedded in the transferred glue.

The amount of glue to be applied is metered out with a controllable blade coater, among other things so that the glue cannot penetrate to the inside of the book. The height adjustment of the roller and the blade coater position must be carefully coordinated for this. Subsequently, the excess glue that is applied is leveled out with the aid of a vertically adjustable ductor blade or a leveling roller.

With known glue spreaders, the blade coaters are adjusted or set manually or via motor-driven cam disks, which act upon a control lever that is connected to the blade coater shaft. In addition, devices for which the blade coaters can be adjusted with the aid of adjustment motors that actuate a differential gear or a planetary gear are known. Also known are blade coaters operated with pneumatic cylinders, which are assigned an adjustable end stop.

The above mentioned known devices involve a relatively high design expenditure and require several elements to be effective. As a result, the adjustment accuracy suffers, especially due to existing or unavoidable play. Inaccuracies are unavoidable, even with the pneumatic actuation of a blade coater, since the speed for a pneumatic drive cannot be changed proportional to the machine speed.

SUMMARY OF THE INVENTION

It is an object of the invention to provide a glue spreader of the above-described type which permits an easy, exact and reliable adjustment of a blade coater.

The above and other objects are achieved according to the invention by the provision of a glue spreader for spreading glue to a back or adjacent area of a book block of gathered printed pages conveyed past the glue spreader on a conveyor, comprising: a tub for holding the glue; at least one application roller, adapted for being driven in the same direction and at the same speed as the book block, submerged in the tub for taking up the glue and transferring the glue to the back of the book block; a blade coater adapted for arrangement above the glue level in the tub at a changeable distance to the application roller; an actuation element coupled to the blade coater for adjustment of the blade coater for determining a thickness of a glue film to be transferred to the book block back based on the changeable distance to the application roller; and a controllable electric motor having a drive element, wherein the actuation element of the blade coater is operatively connected to the drive element of the controllable electric motor.

As a result of the invention, less space is required as compared to known embodiments. The actuation element for the blade coater is advantageously designed as a pivoting shaft, which makes it easy to establish a direct drive connection with an electric motor.

Owing to the fact that small masses must be accelerated, an electric motor designed as a linear motor is highly suitable for actuating a blade coater. Of course, a rotary electric motor can also be used for actuating the blade coater.

The invention is explained in the following with the aid of two exemplary embodiments and by referring to the drawing, which is referred to with respect to all details not explained further in the description.

DETAILED DESCRIPTION OF THE INVENTION

Figure 1:
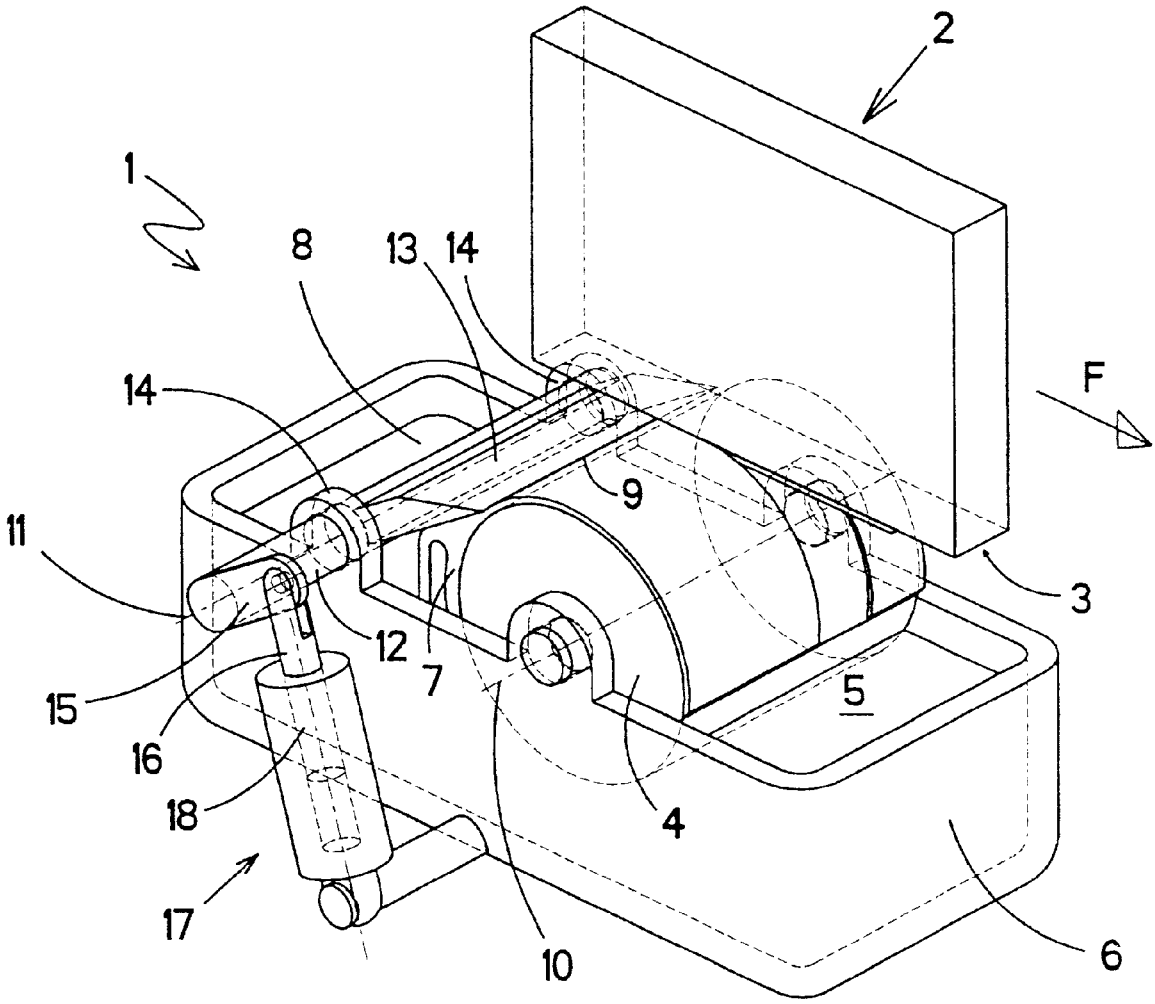
FIG. 1 is a perspective representation of a glue spreader for an adhesive binding machine.
Figure 2:
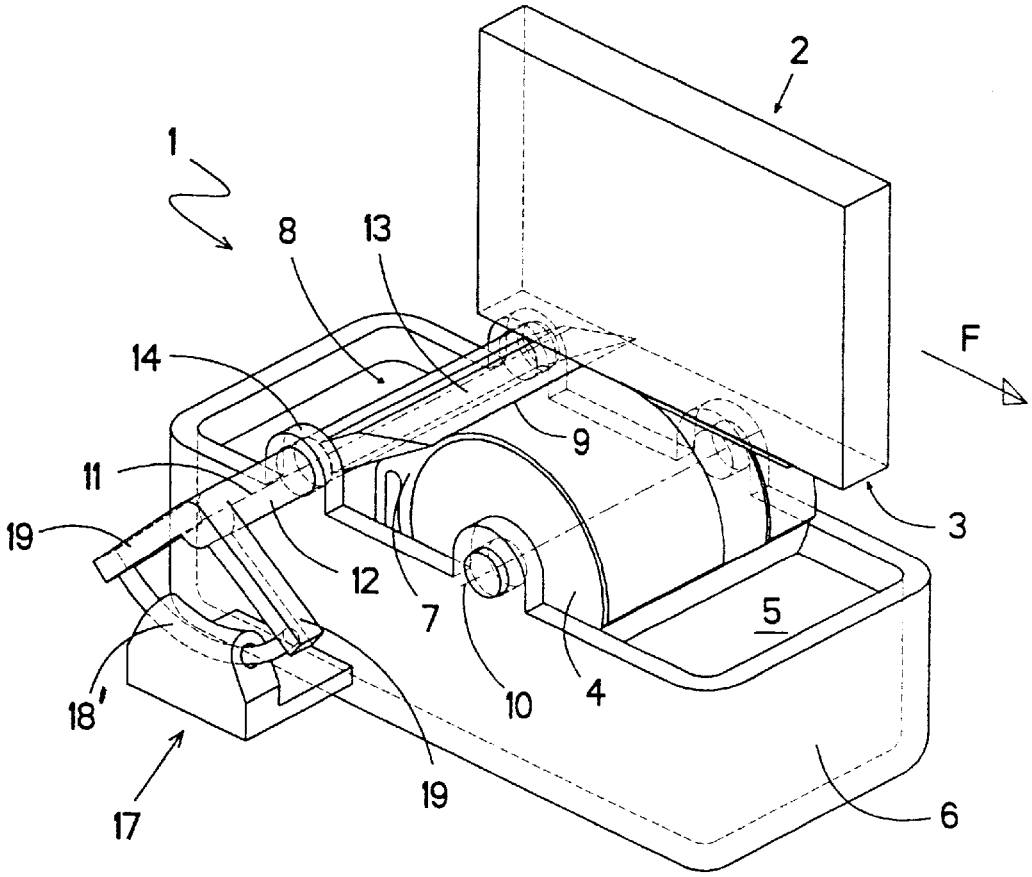
FIG. 2 is perspective representation of an alternative glue spreader for an adhesive binding machine.

FIGS. 1 and 2 show a glue spreader 1 for an adhesive binding machine; designed to produce book blocks 2, consisting of gathered printed pages. While the book blocks 2, which are gripped by gripping devices (not visible) of a conveyor (not visible) that conveys in conveying direction F, move past the glue spreader 1, glue is applied to the backs 3 that project from the gripping devices. An application roller 4 is provided for this, the rotational axis of which extends crosswise to the conveying direction F. The application roller takes up glue with its outer surface that is submerged into a tub 6 containing glue 5 and transfers this glue overshot to the back 3 of the book block 2. The glue film 7 adhering to the application roller 4 passes by an adjustable blade coater 8, which determines the amount of glue 5 to be transferred to the back 3. The distance between application roller 4 and back 3 of the book block 2, as well as the distance between blade coater 8 and application roller 4 can be adjusted or set. The back 3 of book block 2 and the outer shell of the application roller 4 move in the same direction and at the same speed in the region where the glue is transferred. The blade coater 8 scrapes excess glue 5 off the application roller 4 and smoothes the surface of the glue film and for this purpose is provided with a scraping element 13 having a blade-type trailing end edge 9. The glue 5 that is scraped off the application roller 4 by the blade coater 8 subsequently flows back into the tub 6.

The glue spreader 1, illustrated in FIG. 1, has a shaft 12 with axis 11 that extends parallel to the rotational axis 10 of the glue application roller 4. Shaft 12 is the actuating element of the blade coater 8, More specifically, scraping element 13 is attached to shaft 12 for pivoting around axis 11 thereby adjusting the distance between the edge 9 of scraping element 13 and the outer surface of application roller 4. The shaft 12 is positioned on pivoting bearings 14, which are anchored to the tub 6. One end of the shaft 12 is provided with a bracket-type lever 15, which is connected to a drive rod 16 of a linear motor 17 that is coupled to a machine frame or the tub 6. The drive rod 16 is designed as an extension of the armature 18 for linear motor 17.

The glue spreader 1 shown in FIG. 2 differs with respect to the design shown in FIG. 1 in that the armature 18' in FIG. 2 is embodied in the form of a circular arc segment as compared to the straight armature 18 in FIG. 1. The extended ends of armature 18' are attached to extension arms 19 that project in a radial direction outward from the shaft 12 and form an obtuse angle.

The invention has been described with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A glue spreader for spreading glue to a back or adjacent area of a book block of gathered printed pages conveyed past the glue spreader on a conveyor, comprising:

a tub for holding the glue;

at least one application roller drivable in the same direction and at the same speed as the book block submerged in the tub in order to take up the glue and transfer the glue to the back of the book block;

a blade coater adapted for arrangement above the glue level in the tub at a changeable distance to the application roller;

an actuation element coupled to the blade coater for adjustment of the blade coater for determining a thickness of a glue film to be transferred to the book block back based on the changeable distance to the application roller; and a controllable electric motor having a drive element, wherein the actuation element of the blade coater is operatively connected to the drive element of the controllable electric motor.

2. The glue spreader according to claim 1, wherein the actuation element for the blade coater comprises a pivoting shaft.

3. The glue spreader according to claim 2, wherein the electric motor comprises a linear motor.

4. The glue spreader according to claim 3, wherein the linear electric motor has one armature connected to the actuation element for the blade coater.

5. The glue spreader according to claim 4, and further including extension arms projecting from the pivoting shaft and defining a circular segment, wherein the pivoting shaft has an axis and the armature of the linear motor is connected to the extension arms and is drivable for oscillating around the axis of the pivoting shaft.

6. The glue spreader according to claim 2, wherein the electric motor comprises a rotating motor.

7. The glue spreader according to claim 6, and further including a programmable control connected to the electric motor.

* * * * *